US011576446B2

(12) United States Patent
Mazzarolo et al.

(10) Patent No.: US 11,576,446 B2
(45) Date of Patent: Feb. 14, 2023

(54) STANDALONE WEARABLE PROTECTOR AND PROTECTIVE CLOTHING ASSEMBLY

(71) Applicant: Alpinestars Research S.p.A., Maser (IT)

(72) Inventors: Giovanni Mazzarolo, Coste di Maser (IT); Marco Signorelli, Albignasego (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 886 days.

(21) Appl. No.: 14/400,930

(22) PCT Filed: May 14, 2013

(86) PCT No.: PCT/IB2013/053928
§ 371 (c)(1),
(2) Date: Nov. 13, 2014

(87) PCT Pub. No.: WO2013/171674
PCT Pub. Date: Nov. 21, 2013

(65) Prior Publication Data

US 2015/0128334 A1 May 14, 2015

(30) Foreign Application Priority Data

May 15, 2012 (IT) ..... TV2012A000084

(51) Int. Cl.
*A41D 13/018* (2006.01)
*A41D 13/05* (2006.01)

(52) U.S. Cl.
CPC ..... *A41D 13/018* (2013.01); *A41D 13/0506* (2013.01); *A41D 13/0512* (2013.01); *A41D 13/0518* (2013.01); *A41D 13/0531* (2013.01)

(58) Field of Classification Search
CPC ..... A41D 13/018; A41D 13/0506; A41D 13/0512; A41D 13/0518; A41D 13/0531; A41D 13/02
See application file for complete search history.

(56) References Cited

U.S. PATENT DOCUMENTS 4,143,197 A * 3/1979 Jasionowicz ..... A41D 31/0011 139/420 R
4,397,046 A 8/1983 Steiner
(Continued)

FOREIGN PATENT DOCUMENTS

CN 1878482 A 12/2006
DE 29521373 U1 3/1997
(Continued)

OTHER PUBLICATIONS

Declaration of Kristian Ghedina dated Oct. 3, 2016, 2 pages.
(Continued)

*Primary Examiner* — Khoa D Huynh
*Assistant Examiner* — Brieanna Szafran
(74) *Attorney, Agent, or Firm* — Fredrikson & Byron, P.A.

(57) ABSTRACT

The present invention relates to a standalone wearable protector, including a thin layer supporting fabric, at least one inflatable bag housed in a seat provided in said supporting fabric, at least one gas generator acting as inflating means connected to said inflatable bag and fastened directly or indirectly to said supporting fabric, a control unit also fastened directly or indirectly to said supporting fabric and suitable for activating said inflating means and sensing means connected to said control unit and provided on said supporting fabric. The present invention also relates to a protective clothing assembly including a protective garment
(Continued)

made of material resistant to abrasion and friction stresses and said standalone wearable protector.

9 Claims, 11 Drawing Sheets

(56) References Cited

U.S. PATENT DOCUMENTS

| | | | | |
|---|---|---|---|---|
| 5,362,098 | A | 11/1994 | Guill | |
| 5,535,446 | A | 7/1996 | Pusic | |
| 6,125,478 | A * | 10/2000 | Alaloof | A41D 13/018 2/456 |
| 7,299,507 | B1 | 11/2007 | Hermoso et al. | |
| 2003/0188371 | A1 | 10/2003 | Duhammel et al. | |
| 2004/0111790 | A1* | 6/2004 | Dainese | A41D 13/018 2/456 |
| 2004/0177425 | A1 | 9/2004 | Kerr | |
| 2005/0067816 | A1 | 3/2005 | Buckman | |
| 2006/0175810 | A1 | 8/2006 | Goto | |
| 2006/0248632 | A1 | 11/2006 | Colombo | |
| 2009/0055053 | A1* | 2/2009 | Carmeli | A41D 13/018 701/45 |
| 2012/0023648 | A1 | 2/2012 | Dainese | |

FOREIGN PATENT DOCUMENTS

| | | | |
|---|---|---|---|
| EP | 1001688 | | 2/1999 |
| EP | 1615514 | | 6/2005 |
| EP | 1315427 | A1 | 12/2005 |
| EP | 2373188 | A2 | 10/2011 |
| EP | 2671463 | A1 | 12/2013 |
| GB | 2434964 | A | 8/2007 |
| JP | S57047235 | A | 3/1982 |
| JP | H0537911 | U | 5/1993 |
| JP | 2004508235 | A | 3/2004 |
| JP | 2007518885 | A | 7/2007 |
| JP | 2010125992 | A | 6/2010 |
| WO | 9904661 | A1 | 2/1999 |
| WO | 0051453 | A1 | 9/2000 |
| WO | 2005048754 | A1 | 6/2005 |
| WO | WO2009047733 | * | 4/2009 |
| WO | 2010140176 | A1 | 12/2010 |

OTHER PUBLICATIONS

Retico, "At the Olympic games with the airbag, the ski revolution is ready," excerpt of LaRepubblica.it, online newspaper, retrieved from http://ricerca.repubblica.it/repubblica/archivio/repubblica/2012/01/18/alle-olimpiadi-con-airbag-la-rivoluzione.html, dated Jan. 18, 2011, including an English translation of the most relevant parts, 1 page.

Caliendo, "Dainese at Eicma 2010. Shown the D-air in two versions, Racing and Street," retrieved from Omnimoto (http://www.omnimoto.it/magazine/5519/dainese-ad-eicma-2010-d-air) dated Nov. 8, 2010, including an English translation of the most relevant parts, 19 pages.

Macaluso, "Dainese D-air Street safety system," retrieved from Motoblog (http://www.motoblog.it/post/33681/dainese-alleicma-2011-con-il-sistema-di-sicurezza-d-air-street) dated Nov. 25, 2011; including an English translation of the most relevant parts, 12 pages.

"Dainese presents the airbag for motorcyclists with electronic activation," retrieved from Sicurmoto (http://www.sicurmoto.it/2010/11/19/dainese-presenta-I%E2%80%99airbag-per-motociclisti-ad-attivazione-elettronica-ma-e-solo-un-prototipo/) dated Nov. 19, 2010, including an English translation of the most relevant parts, 14 pages.

Excerpt of Panorama, online magazine, retrieved from http://archivio.panorama.it/sport/foto/D-air-Ski-Dainese-e-la-Fis-mettono-I-airbag-anche-agli-sciatori, dated Jan. 20, 2012, 2 pages.

PCT International Search Report and Written Opinion dated Aug. 28, 2013 for Intl. App. No. PCT/IB2013/053928, from which the instant application is based, 11 pgs.

"Airbag Technology for Skiing," Mundo Deportivo (Newspaper) Feb. 2, 2011, 3 pages.

"Airbags for Skiing," Polideportivo (Newspaper) Jan. 30, 2011, 3 pages.

"Airbag-system: the first prototype is there," LAOLA1 Multimedia GmbH, published at <URL: http://www.laola1.at/de/wintersport/ski-alpin/>, Jan. 20, 2012, 7 pages.

Communication and invitation to correct deficiencies in European Pat. App. No. 15173704.6, dated Nov. 19, 2015, 3 pages, European Patent Office, Rijswijk, Netherlands.

"FIS and Dainese working on airbag," Kleine Zeitung (Newspaper) Jan. 19, 2012 [retrieved from the Internet on Jan. 7, 2016] retrieved from <URL: http://www.kleinezeitung.at/s/sport/wintersport/skialpin/3915823/ Schi-Alpin_FIS-und-Dainese-arbeiten-an-Airbag-> 3 pages.

"Great progress towards applying air bag technology to ski racing," FIS and Dainese SpA Press Release, Jan. 19, 2012, 3 pages.

Molinaro, Pierangelo, "Down with the risks. The jet men will have the airbag," Gazzetta Dello Sport Gazzetta Dello Sport (Newspaper) Jan. 20, 2012, [retrieved from the Internet on Jan. 7, 2016] retrieved from <URL:http://archiviostorico.gazzetta.it/2012/gennaio/20/Abbasso_rischi_Gli_uomini_jet_ga_10_12012011_559.shtml>, 4 pages.

Opinion and Search Report regarding Italian Pat. App. No. ITTV20120084, dated May 15, 2012, 8 pages, Italian Patent and Trademark Office, Rome, Italy.

Poli, Marisa, "Also the skiers will have the Airbag of Valentino," Gazzetta Dell Gazzetta Dello Sport (Newspaper) Jan. 27, 2011, [retrieved from the Internet on Jan. 7, 2016] retrieved from <URL: http://archiviostorico.qazzetta.it/2011/qennaio/27/Anche_discesisti_avranno_gli_airbag_ga_10_110_127044.shtml?refresh_ce-cp>, 4 pages.

Vanetti, Flavio, "From the motorcycles to the snow; the airbag for the skier. Disclosed at Kitzbuhel, on the very dangerous Streiff, a system for protecting the skiers from back injuries," Corriere Della Sera (Newspaper) Jan. 19, 2012, [retrieved from the Internet on Jan. 7, 2016] retrieved from <URL: http://www.corriere.it/sport/12_gennaio_19/sci-airbag-vanetti_38780af0-42ac-11e1-8207-8bde7a1445db.shtml>, 5 pages.

"Fall Off Your Bike, Then Bounce," Popular Science, Jan. 2002, p. 11.

Papetti, "Alpinestars Tech-Air Race: sicurezza da Moto GP per tutti," Retrieved online from <http://www.motocorse.com/news/abbigliamento/31220_Alpinestars_Tech-Air_Race_sicurezza_da_Moto_GP_per_tutti.php>, published Nov. 11, 2011, 6 pages (including 2 pages English Translation).

Morandin, Declaration of Dolomiticert, Request identification abrasion test, dated Mar. 19, 2018, 3 pages (including 1 page English translation).

Ghedina, Declaration of Kristian Ghedina, dated Jan. 25, 2018, 9 pages (including 1 page English translation).

EP Patent No. 2671463, Communication of a Notice of Opposition, dated May 17, 2016, 30 pages.

"EN 13595-1 EN 13595-2 EN 13595-3 EN 13595-4 (clothing)," Printout from http://motosicurezza.com, posted by Redazione Motos on Apr. 11, 2009, retrieved Mar. 28, 2018, 8 pages (including 3 pages English translation).

Scott, Excerpt from Textiles for Protection, 2005, p. 721.

Printout from www.pva-ppe.org uk, believed to be available more than one year prior to the filing date of the instant application, 8 pages.

Pictures of a specimen of D_Air Street, Apr. 30, 2012, 10 pages.

Pictures of a specimen of D_Air Racing, Jul. 29, 2011, 31 pages.

* cited by examiner

STANDALONE WEARABLE PROTECTOR AND PROTECTIVE CLOTHING ASSEMBLY

RELATED APPLICATIONS

This application is a 35 U.S.C. 371 national stage filing from International Application No. PCT/IB2013/053928 filed May 14, 2013 and claims priority to Italian Application No. TV2012A000084 filed May 15, 2012, the teachings of which are incorporated herein by reference.

Field of the Invention

The present invention relates to a standalone wearable protector. The invention also relates to a protective clothing assembly comprising a protective garment and said standalone wearable protector.

In particular the present invention refers, even if in a non exclusive way, to a standalone wearable protector and to a protective clothing assembly suitable for being worn by a motorcyclist.

Background

It is well known that motorcycle riding is a dangerous activity due to the speed that the riders travel at and the limited protection that clothing can provide if the rider is involved in a crash situation. As a crash situation it should be intended both a falling of the rider, following to the loss of control of a motorcycle, and/or collision of the motorcycle driven by the rider with another vehicle or obstacle.

The loss of control of the motorcycle can cause either a sliding of the rider over the ground or a sudden unsaddlement of the rider who is launched into air before impacting the ground.

For reducing the injury risk, the riders wear protective clothing. Such protective clothing generally consists of an abrasion resistant garment, made of leather or synthetic material, which is provided in some areas, for example in the region of the shoulders, the knees, the back, with some body armour suitable for limiting impact forces acting on the garment.

Recently, the protection offered by said motorcycling protective clothing against impacts has been improved thanks to the integration, into the abrasion resistant garment, of inflatable protective devices.

EP 1615514 and WO 2010/140176 illustrate some examples of abrasion resistant garments, provided with inflatable protective devices, which have been proposed by the same applicant over the years.

Said abrasion resistant garments are characterized by the fact that the components of the inflatable protective device, i.e. a network of sensors, a control unit, inflation means and inflatable bladders, are integrated in the structure of the garment, thus forming a whole with the abrasion resistant garment.

The control unit is suitable for monitoring the status of the rider and, when a crash situation is detected, it is able to quickly activate the inflation means whereby the inflatable bladders, which are connected to the inflation means, are inflated for improving the impact absorbing properties of the protective garment.

Advantageously, the inflatable bladders, in their deflated status, take up very little thickness and thus, being inflated only in response to a crash situation, the bulk and/or the thickness of the abrasion resistant garment on which they are integrated is substantially not increased. Therefore, the integration of an inflatable protective device in the structure of an abrasion resistant garment does not hinder the rider during normal riding.

However, even if the above mentioned abrasion resistant garments are greatly appreciated and offer a higher level of safety to the riders, some problems arise from the integration of the inflatable protective device into the abrasion resistant garment.

The first drawback is that if and when the rider undergoes an accident, causing the abrasion resistant garment to be damaged, the rider, in order to prosecute the same race and/or the same race season, must have at hand another new abrasion resistant garment provided with its own inflatable protective device, of a size proper for him.

Moreover each rider, due to different climatic seasons and local environmental conditions at which he/she have to operate, must also have available abrasion resistant garments with inflatable protective device) suitable for at least two different seasons, namely autumn plus winter and springtime plus summer.

As a matter of fact, the abrasion resistant garment used during autumn/winter is manufactured differently from the one used during springtime/summer.

Moreover, since the inflatable device cannot be easily separated from the abrasion protective garment, without compromising the structure of the garment, when the inflatable device has been activated and thus the inflation means must be recharged, the entire protective garment must be returned to the manufacturer. In this case, the shipment of the protective garment is costly since the garment is bulky.

Furthermore, the life-cycle of the abrasion protective garment and the one of the inflatable protective device might differ in time. For example, if the garment is somehow damaged or just exhausted over time, it is possible that the inflatable device might still be fully usable. Therefore, until now if the rider is willing to replace his/her abrasion protective garment he/she would have to sustain the unnecessary cost of at least one further inflatable protective device.

It is readily appreciated that the above situation and requirements increase not negligibly the costs for each rider.

From U.S. Pat. No. 4,397,046 it is known a protecting device suitable for being incorporated or attached in a removable manner to a clothing.

The elements of the protecting device disclosed in U.S. Pat. No. 4,397,046 are constituted of two superimposed lavers made of leather, or of synthetic material presenting similar properties, the internal layer being fine and soft whereas the external layer being more thick and more rigid.

Due to the presence of said external layer having a protection function, the protecting device of U.S. Pat. No. 4,397,046 is not able to easily adapt itself to different shapes of the user's body.

Furthermore, the protecting device of U.S. Pat. No. 4,397,046 is not provided with sensing means suitable for detecting a danger situation. As a matter of fact, the protecting device of U.S. Pat. No. 4,397,046 is activated when the ejection of the motorcyclist with regards to the motorcycle leads to the sudden disconnection of a tether cable, the latter remaining fixed to the motorcycle, and releases the introduction of gas into the protecting device. Therefore, the protecting device of U.S. Pat. No. 4,397,046 is not a standalone device.

From US 2006/0175810 it is known a protective clothing provided with air bags. The protective clothing of US 2006/0175810 comprises stretchable inserts which allow the expansion and deployment of the air bags.

However, the protective clothing of US 2006/0175810 is not provided with a separable lining and the air bags are directly disposed on the protective clothing. Therefore, it is not possible to replace the airbags without replacing the whole protective clothing.

Brief Summary of Embodiments of the Invention

The main purpose of the present invention is that of substantially solving the above problems and partially that of permitting the rider, undergoing an accident in which the abrasion resistant garment (provided with an inflatable protective device) is damaged, to readily restore his/her safe condition, namely having both an abrasion resistant garment and an inflatable protective device in full operating condition, within a short time from the accident. In this way the rider is allowed both to continue the same race and/or be able to prosecute a race season without additional costs.

Another aim of the present invention is to provide an inflatable protective device having a stand-alone structure which is able to offer a high protection to the rider without needing to be connected to any external device or to be integrated inside the structure of a protective garment.

A further aim of the present invention is to provide an inflatable protective device which can be used in conjunction with compatible abrasion protective garment.

Another aim of the present invention is to provide an inflatable protective device which can be easily worn underneath or on top of existing abrasion protective garment.

At last, a further aim of the present invention is to provide an inflatable protective device which can be easily maintained and recharged after having been used.

These and other objects are achieved by providing an inflatable protective device consisting of a standalone wearable protector, comprising: a thin layer supporting fabric, at least one inflatable bag housed in a seat provided in said supporting fabric, at least one gas generator acting as inflating means connected to said inflatable bag and fastened directly or indirectly to said supporting fabric, a control unit also fastened directly or indirectly to said supporting fabric and suitable for activating said inflating means and sensing means connected to said control unit and provided in said supporting fabric.

These and other objects are also achieved by providing a protective clothing assembly comprising a protective garment made of material resistant to abrasion and friction stresses and said standalone wearable protector.

BRIEF DESCRIPTIONS OF DRAWINGS

The advantages and the characteristic features of the invention will appear more clearly from the following description of a preferred, but not exclusive, embodiment of the standalone wearable protector which refers to the accompanying figures in which.

DETAILED DESCRIPTION OF EMBODIMENTS OF THE INVENTION

Figure 1:
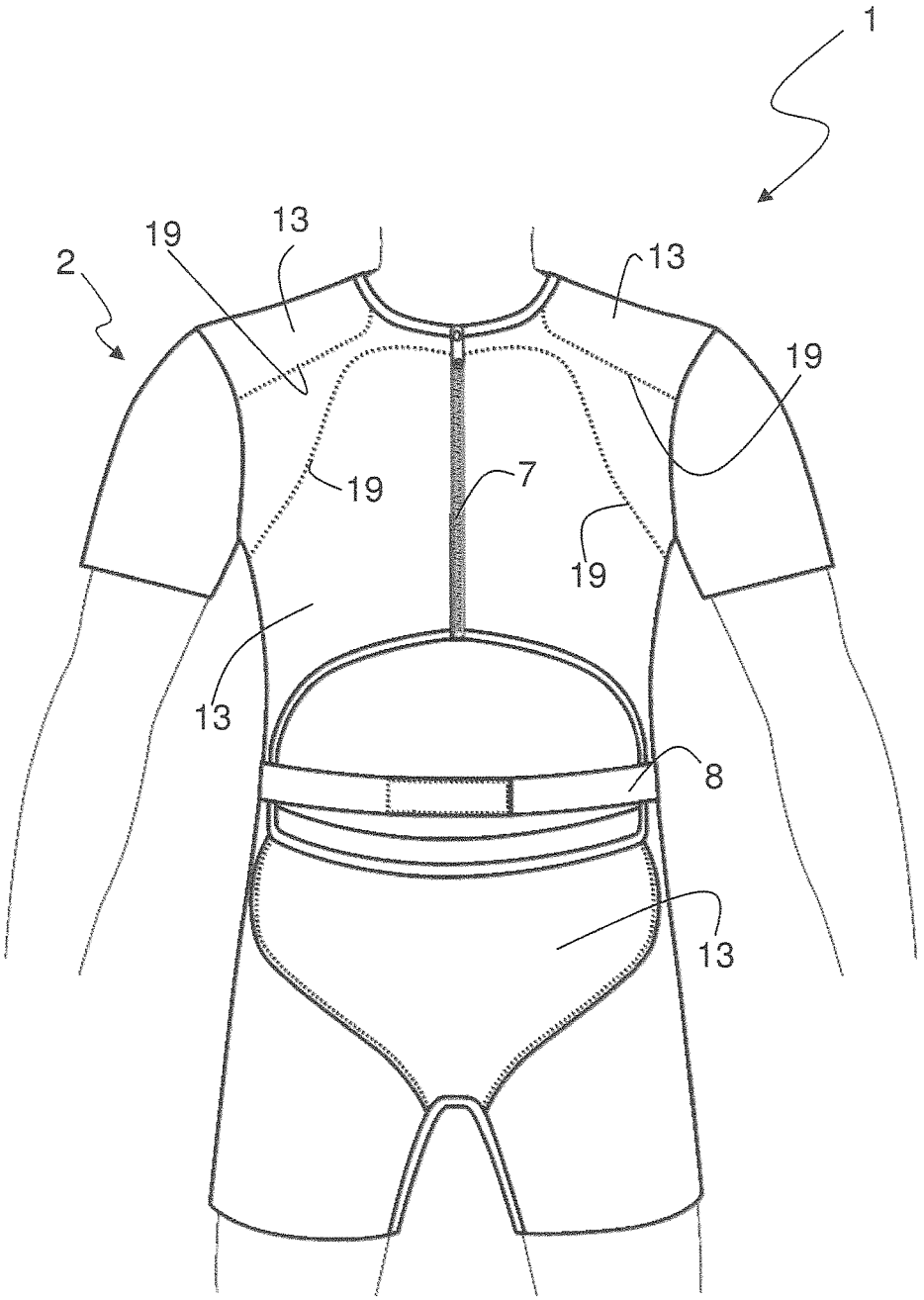
FIG. 1 shows a front view of a first embodiment of the standalone wearable protector according to the invention.

In the following description, as "standalone device" there will be indicated a device that does not require to be connected to any other device for properly accomplishing its functions. Specifically, as "standalone device" there must be meant a device which is capable of operating independently from any other device.

As "inner surface" or "inner portion" there will be indicated the surface or portion of a device and its individual component that, when the device is in use, i.e. is worn by a user, is near to the body of the user, while as "outer surface" or "outer portion" there will be indicated the surface or portion of a device and its individual component that, when the device is in use, is opposite to the inner surface or portion.

With reference to the attached figures, an example of a standalone wearable protector, according to the invention, is indicated in its whole by the reference 1. Said standalone wearable protector 1 is suitable for being used in particular by motorcycle drivers. Nevertheless, as it will appear more clearly from the following description, the standalone wearable protector 1 can also be advantageously used by cyclists or in other fields where an effective protection of the user's body must be obtained The standalone wearable protector 1 comprises a thin layer supporting fabric 2 suitable for being worn by a user, like a shirt or a T-shirt. Said thin layer supporting fabric 2 covers at least a trunk portion of the user's body.

The standalone wearable protector 1 also comprises at least one inflatable bag 13, which is housed in a seat 19 provided in the thin layer supporting fabric 2, and at least one gas generator 12 acting as inflating means. The gas generator 12 is connected to said at least one inflatable bag 13 and it is fastened directly or indirectly to said thin layer supporting fabric The standalone wearable protector 1 further comprises a control unit 10 which is also fastened directly or indirectly to said thin layer supporting fabric 2 and it is suitable for activating said inflating means 12.

The standalone wearable protector 1 also comprises sensing means 5 which are connected to said control unit 10 and provided in said thin layer supporting fabric 2.

The control unit 10 is suitable for activating the gas generator 12 when a danger situation is detected by the sensing means 5.

According to the definition previously done, the wearable protector 1 of the present invention is a standalone device since all its functional elements, i.e. inflatable bag 13, sensing means 5, control unit 10 and gas generator 12, are arranged on the thin layer supporting fabric 2. After having worn the standalone wearable protector 1, the user does not have to connect any component of the wearable protector 1 with external devices for making the wearable protector 1 operate.

For example, the control unit 10 does not need to be connected to external power supply and the gas generator 12 does not necessitate to be coupled to an external source of gas. Moreover, the control unit 10 does not require, for properly accomplishing its function, sensing inputs positioned externally to the standalone wearable protector 1.

Even the sensing means 5 and the connections between the various components of the wearable protector 1 are arranged on the thin layer supporting fabric 2. In any case, said network connections can be wireless.

Figure 2:
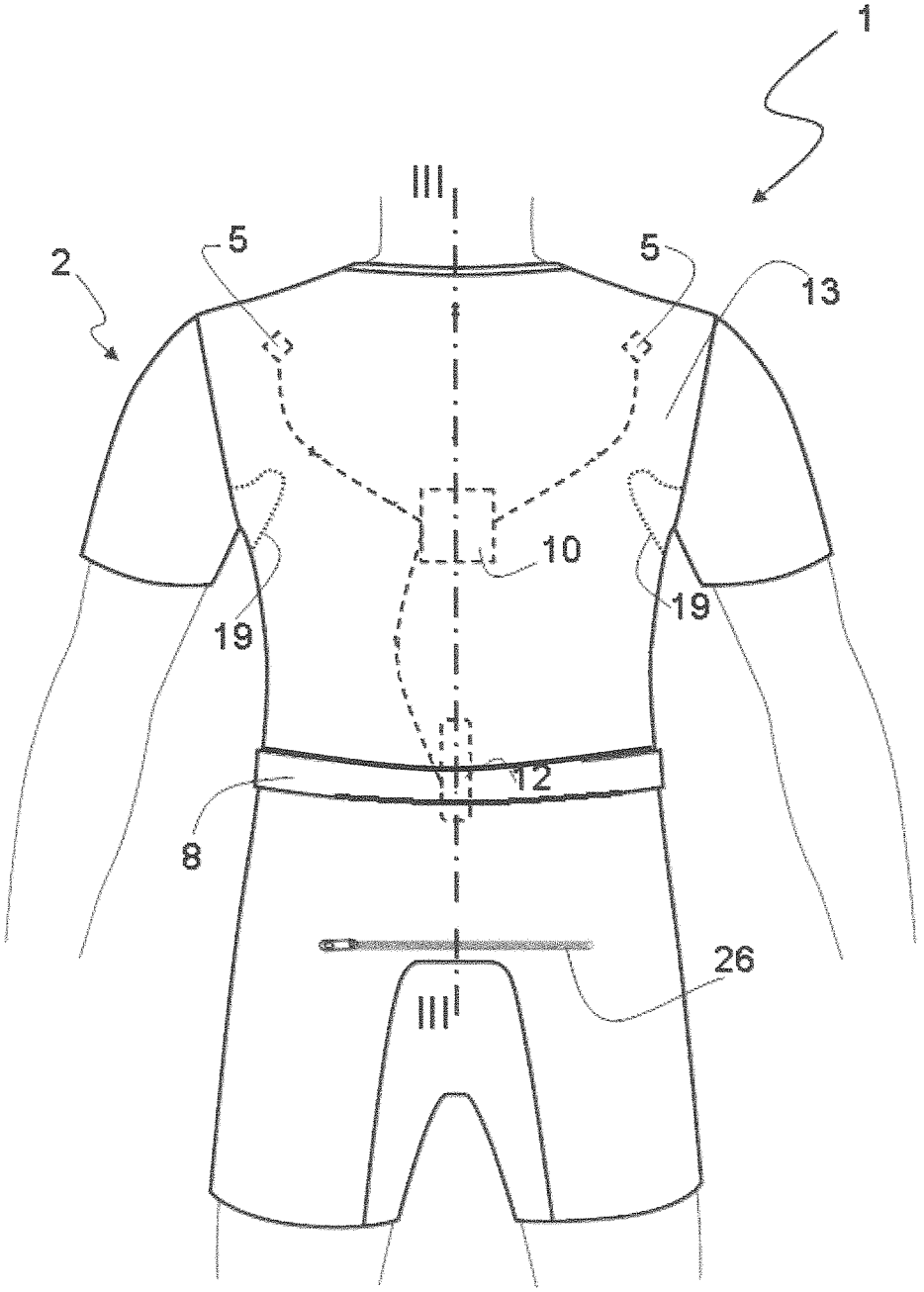
FIG. 2 shows a back view of the standalone wearable protector of FIG. 1.
Figure 2A:
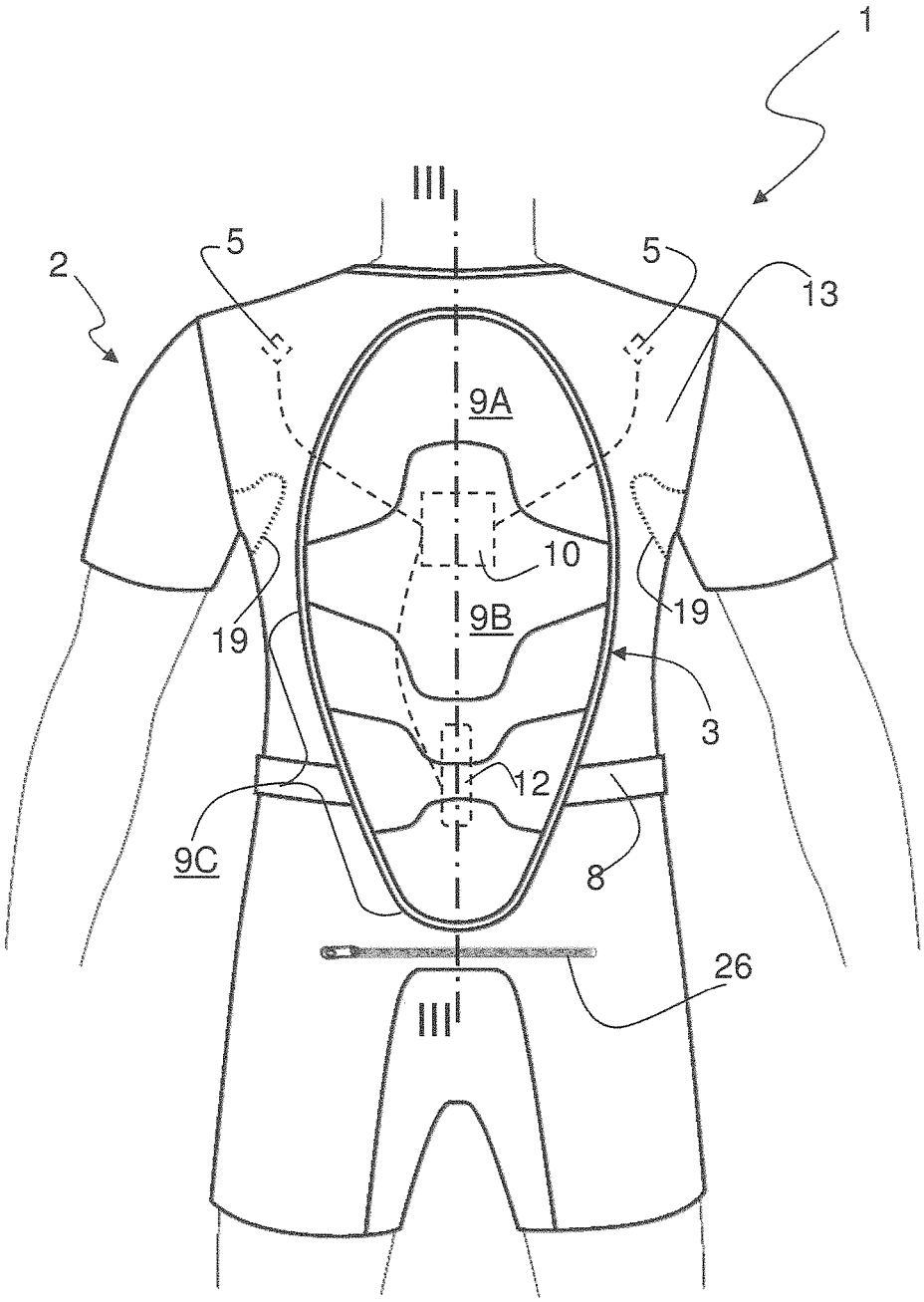
FIG. 2A shows a back view similar to the one of FIG. 2 of a second embodiment of the standalone wearable protector according to the invention.

According to the embodiment shown in FIGS. 1, 2 and 2A the thin layer supporting fabric 2 covers the trunk portion, the hip portion and at least partially the arm portion of the user's body.

Figure 6:
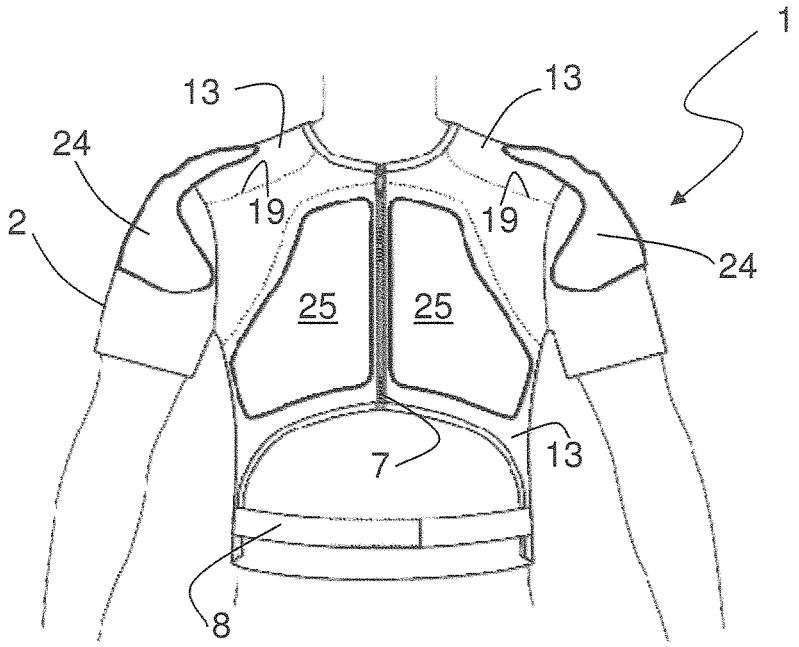
FIG. 6 shows a front view of a further embodiment of the standalone wearable protector according to the invention.
Figure 7:
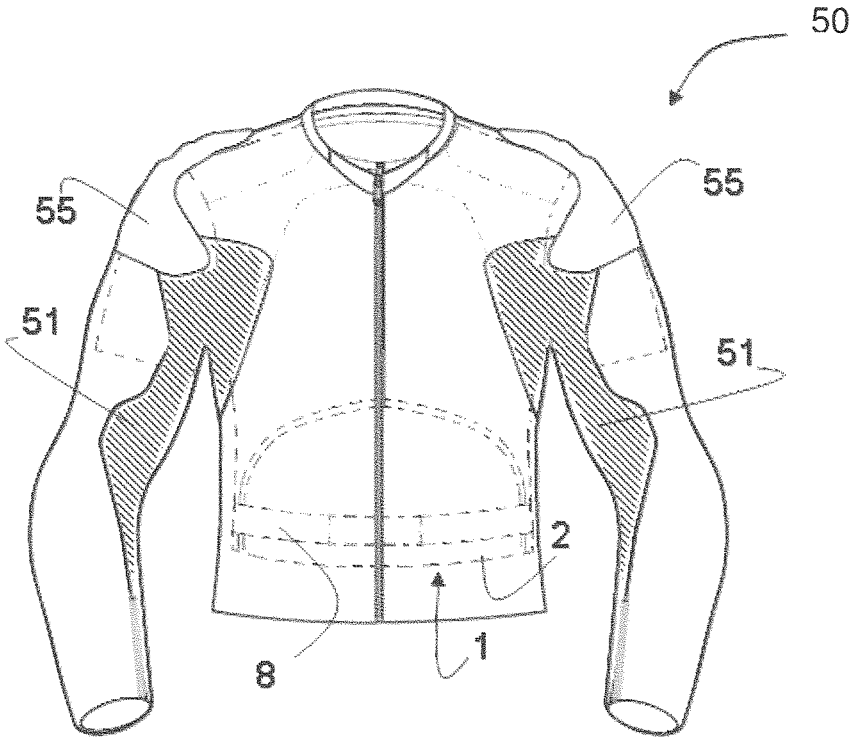
FIG. 7 shows a front view of a further embodiment of the protective clothing assembly according to the invention, in a first operating condition.
Figure 10:
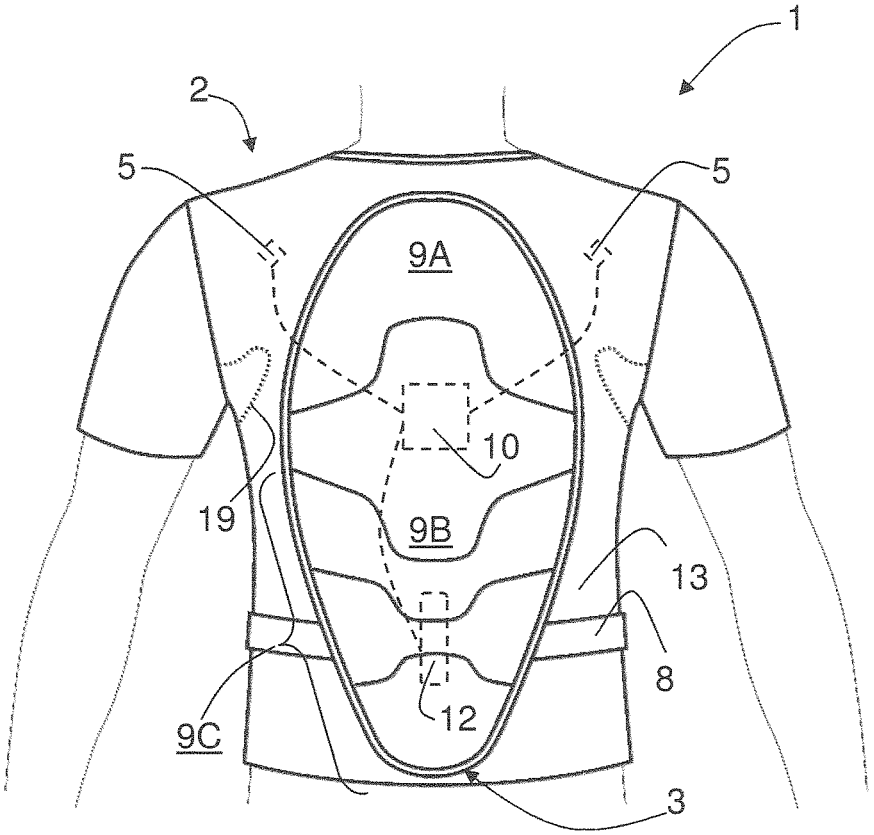

According to the embodiments shown in FIGS. 6, 7 and 10, the thin layer supporting fabric 2 covers the trunk portion and at least partially the arm portion of the user's body.

Figure 8:
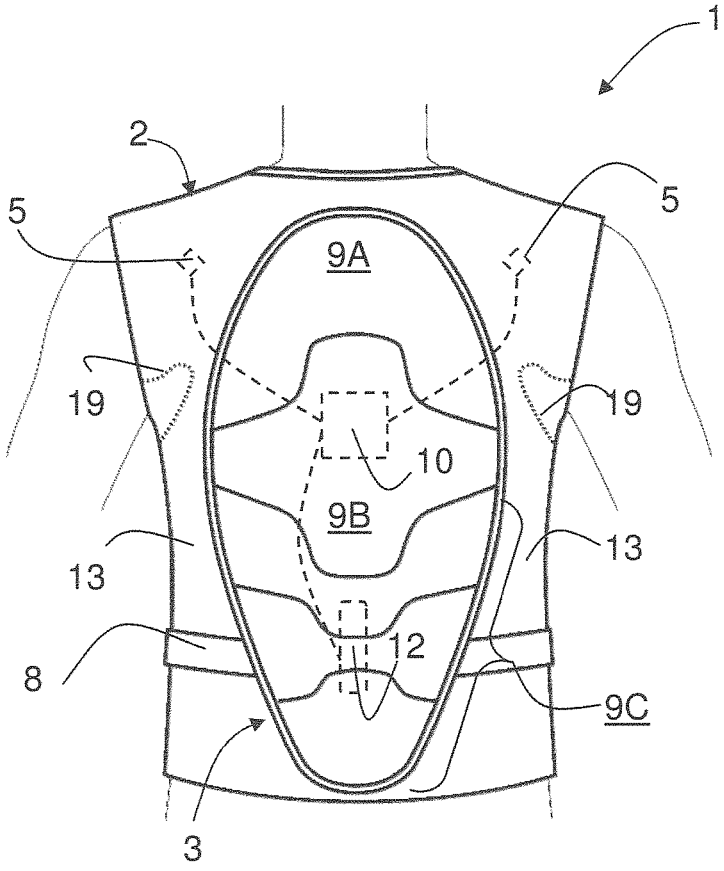
FIGS. 8-10 show back views of different embodiments of the standalone wearable protector according to the invention.

According to the embodiment shown in FIG. 8, the thin layer supporting fabric 2 covers only the trunk portion of the user's body.

Figure 9:
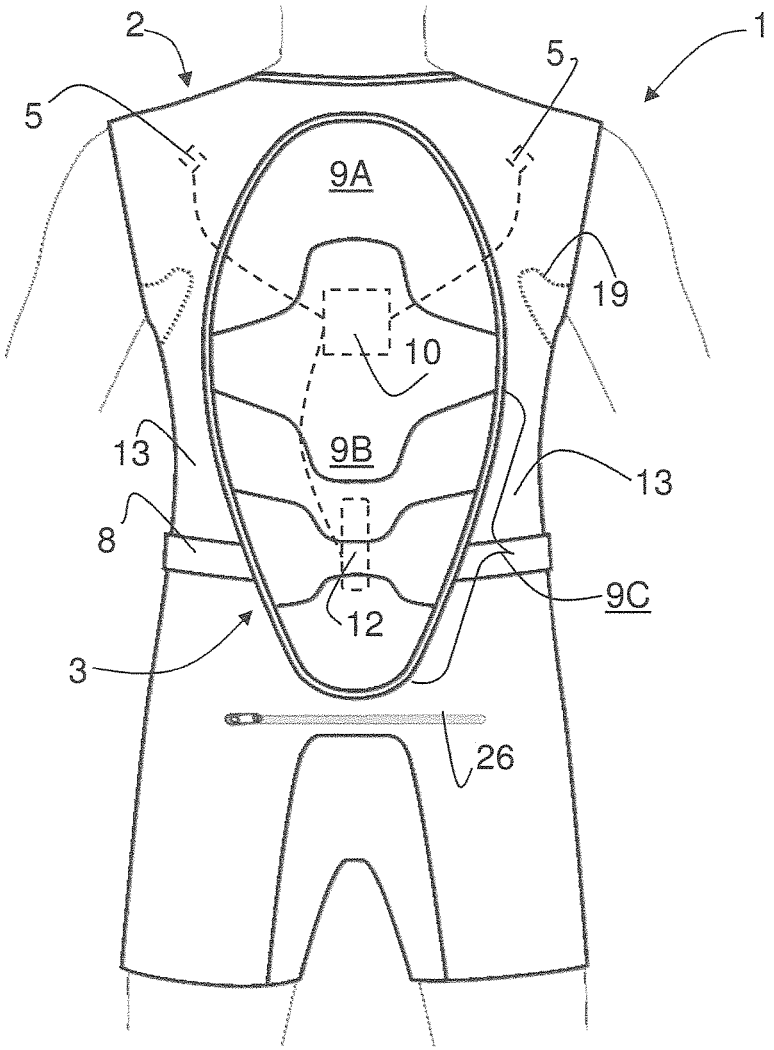

According to the embodiment shown in FIG. 9, the thin layer supporting fabric 2 covers the trunk portion and the hip portion of the user's body.

Obviously, different arrangements of the thin layer supporting fabric 2 are possible, in order to meet other specific needs.

As it can be seen from the attached figures, the user can wear the thin layer supporting fabric 2, and thus the whole standalone wearable protector 1, just like a shirt or a T-shirt.

With reference to the embodiment of the standalone wearable protector shown in FIG. 1, for making easier the wearing of the standalone wearable protector 1, the standalone wearable protector 1 can be provided with a front zip 7. Said front zip 7 can be closed by the user after having inserted his/her arms into the sleeves of the thin layer supporting fabric 2.

For assuring a better fit over the user's body, the standalone wearable protector 1 can also be provided with a fastening waist strap 8.

The function accomplished by the thin layer supporting fabric 2 is specifically to support the various components of the standalone wearable protector 1 without hindering the user's movements. As a matter of fact, according to some embodiments, the thin layer supporting fabric 2 is made of a thin material which can be substantially unable to resist to abrasion and to friction stresses. Therefore such thin layer supporting fabric 2, in case it comes into contact with an obstacle or with the ground directly, could undergo some tears or damages.

Preferably, the thin layer supporting fabric 2 is made of polyester, polyamide, or other synthetic fabrics.

Since the thin layer supporting fabric 2 does not have to provide protection against abrasion, it can have a small thickness. According to a preferred embodiment, the layer supporting fabric 2 has a thickness comprised between 0.1 mm and 0.6 mm. Preferably, the layer supporting fabric 2 has a thickness of about 0.3 mm.

The reduced thickness of the layer supporting fabric 2 allows the standalone wearable protector 1 to stay adherent to the body of the user, without hindering him during the normal riding operation. As it will be disclosed in detail in the following, the reduced thickness of the layer supporting fabric 2 allows the standalone wearable protector 1 to be easily worn both underneath and on top of different garments.

Moreover, according to some embodiments, the thin layer supporting fabric 2 has good elastic properties such that it can easily adapt itself to different shapes of the user's body. Furthermore, due to its elasticity the thin layer supporting fabric 2 does not obstruct the inflation of the inflatable bag 13, when it is activated, allowing it to reach its maximum volume in a very short time.

The structure of the thin layer supporting fabric 2 allows the expansion of the inflatable bag 13 to take place towards the outside of the standalone wearable protector 1, so as to not constrict the user's body.

Preferably, the control unit 10 and the gas generator 12 are applied on the portion of the thin layer supporting fabric 2 covering the back portion of the user.

In a preferred embodiment, the thin layer supporting fabric 2, in the region wherein the gas generator 12 and the control unit 10 are applied, is provided with an impact absorbing foam. Said impact absorbing foam is applied to the thin layer supporting fabric 2 and it is suitable for protecting the back of the user from directly contacting with the control unit 10 and the gas generator 12.

Moreover, the impact absorbing foam is suitable for preventing the back of the user from directly impacting with the control unit 10 and the gas generator 12 in the event of an accident where the inflatable bag 13 is not inflated.

With reference to the FIGS. 2A, 8, 9, 10, the standalone wearable protector 1 preferably comprises a semirigid back shield 3. The semirigid back shield 3 is suitable for covering, when the wearable protector 1 is worn by the user, the back portion of the user.

Figure 3:
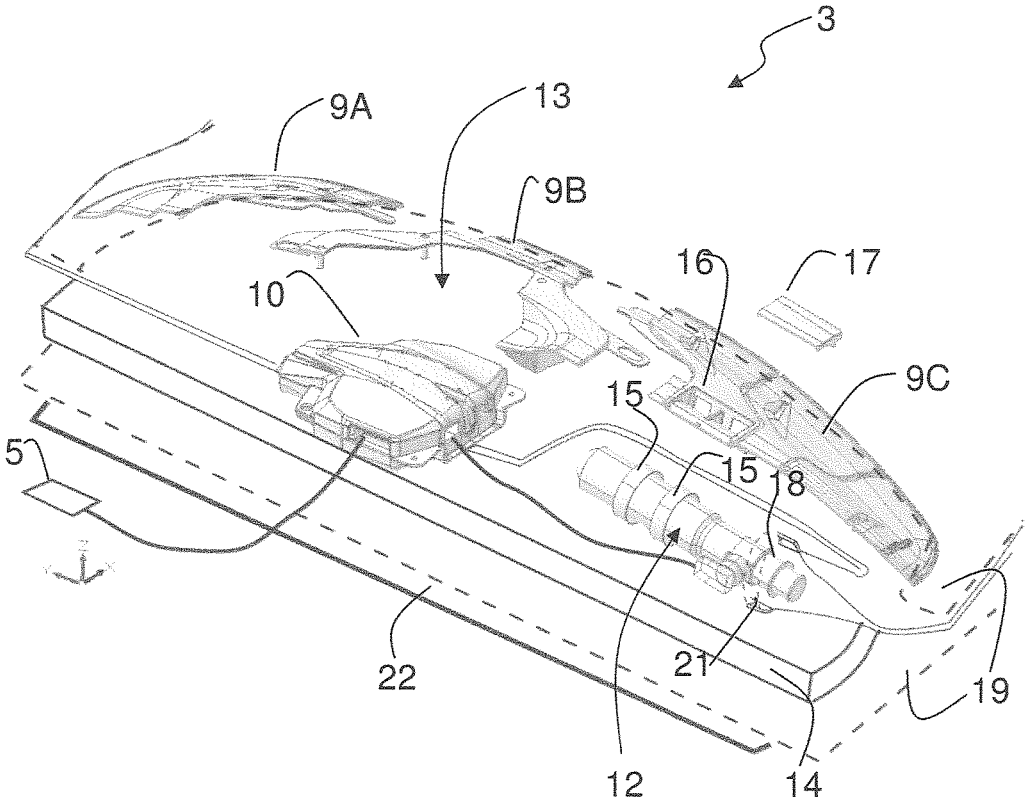
FIG. 3 shows a schematic exploded cross sectional view of a component of the standalone wearable protector according to the plane of FIG. 2A.

Moreover, as it is clearly illustrated in FIG. 3, the semirigid back shield 3 is suitable for housing the control unit 10 and the gas generator 12.

Preferably, said semirigid back shield 3 is permanently fixed, by means for example of stitching, to the thin layer supporting fabric 2.

Said semirigid back shield 3 extends, when the thin layer supporting fabric 2 is properly worn, longitudinally over the back of the user and is shaped so as to cover the spinal area of the user.

The semirigid back shield 3 has preferably an elliptic outer profile.

With reference to the embodiment of FIG. 3, the outer surface of the semirigid back shield 3 may comprise a plurality of elements 9A, 9B, 9C made of polymeric material, like polypropylene. Preferably, on the inner surface of the semirigid back shield 3 an impact absorbing foam 14 is applied. The impact absorbing foam 14 can be made of expanded polystyrene or other energy absorbing compound.

The elements 9A, 9B, 9C can assist, in conjunction with the at least one inflatable bag 13, in distributing impact forces, acting on the back of the user, onto the impact absorbing foam 14. At the same time the elements 9A, 9B, 9C, in conjunction with the impact absorbing foam 14, serve as casing for the control unit 10 and the gas generator 12 of inflatable protective device 1. As a matter of fact, the control unit 10 and the gas generator 12 are positioned between the elements 9A, 9B, 9C and the impact absorbing foam 14.

With reference to the embodiment of FIG. 3, the central element 9B may have an opening 11 designed to accommodate the control unit 10 which, when installed, completes the continuous smooth outer surface of the back shield 3.

However, in other embodiments like those shown in FIGS. 2A and 8, the control unit 10 may be completely hidden inside the back shield 3.

The gas generator 12 is preferably secured to the element 9C of the back shield 3. Said element 9C being the portion of the back shield 3 which, in use, is superimposed to the lumbar portion of the user.

In the embodiment shown in FIG. 3, the gas generator 12 consists of a cylindrical gas generator which is fixed to the inner surface of the element 9C by means of two fixing ring 15.

It is possible to act on such fixing ring 15 through an appropriate shaped opening 16 provided on the element 9C. Such opening 16, when the standalone wearable protector 1 is in use, can be covered by a corresponding lid 17.

The standalone wearable protector 1 preferably comprises a single inflatable bag 13. Preferably said single inflatable bag 13 is arranged on the thin layer supporting fabric 2 so as to cover the chest, ribs, shoulders, back and hips of the user.

However, different arrangements of the single inflatable bag 13 are possible, in order to meet other specific needs.

Obviously, the standalone wearable protector 1 may comprise more than one inflatable bag 13, said inflatable bags 13 being suitable for covering other portions of the body and for operating in combination to each other.

Each inflatable bag 13 is accommodated inside a seat 19 arranged on the thin layer supporting fabric 2. As seat it must be indicated a portion or an element of the thin layer supporting fabric 2 suitable for supporting and for keeping in a proper position the inflatable bag 13 applied to the thin layer supporting fabric 2. Said seat 19 is preferably configured as a pocket arranged on the inner surface of the thin layer supporting fabric 2.

The pocket 19, wherein the inflatable bag 13 is housed, can advantageously be made of the same material of the thin layer supporting fabric 2.

Preferably the inflatable bag 13 is made from a sheet material such as polyamide. A similar inflatable bag is disclosed in the International Patent Publication WO2010/140176 filed in the name of the same applicant.

Said inflatable bag is able to reach a great expansion and it can be inserted inside its seat in a flat configuration without needing to be folded or packed. In this way the provision of inflatable bags on the thin layer supporting fabric 2 does not make the latter bulky and does not hinder the user wearing the standalone wearable protector.

Each pocket 19 is provided with a proper aperture trough which an opening of the inflatable bag 13 can be connected, directly or by means of connection tubing, to the gas generator 12.

Advantageously, as it is shown in FIG. 3, an inflatable bag 13 can also be arranged underneath the back shield 3 inside a proper pocket 19. In this case, the inflatable bag 13, and the corresponding pocket 19, are positioned underneath the gas generator 12 and the control unit 10.

In this case a further reinforcing layer 22 is provided underneath the pocket 19 for providing additional comfort to the user and for better structuring the thin layer supporting fabric 2. This reinforcing layer 22 may consist of expanded foam and/or stiffer fabric and is able to provide a means for weight distribution of the overall structure of the back shield 3.

According to the embodiment of FIG. 3, a fixing ring 21 can be used on a relieved lip 18 of the gas generator 12 to secure the opening of the inflatable bag 13 to the gas generator 12. Advantageously, the relieved lip 18 works with the fixing rig 21 to prevent the inflatable bag 13 from being ejected by the gas generator 12 during inflation.

For fixing the opening of the inflatable bag 13 to the end of the gas generator 12, a different embodiment of the wearable protector 1 envisages the use of releasable fixing means.

In this occurrence, the thin layer supporting fabric 2 can be provided at the lumbar portion with a zip fastener 26 (see FIGS. 2, 2A and 9). In this case, the user, after having opened the zip fastener 26, can have access to the portion of the back protection 3 wherein the gas generator 12 is housed. Successively, the user can unfasten the releasable fixing means and exchange the empty gas generator 12 with a new one.

Preferably the standalone wearable protector 1 comprises a single gas generator However, a possible embodiment of the invention envisages the use of more than one gas generator 12.

In this specific embodiment, if a crash situation is detected by the sensing means 5, the plurality of gas generators 12 can be activated by the control unit 10 simultaneously or according to a predetermined sequence.

In this way, in case the standalone wearable protector 1 contains more than one inflatable bag 13, each inflatable bag 13 can be inflated by a different gas generator 12.

Otherwise, if the inflatable bag 13 has been provided with an escape vent to allow gradual deflation of the chamber, once the bag has been inflated, it will slowly deflate whereby the next gas generator can be activated at a different time in future. In this way, the standalone wearable protector can be used once more, even during the same race, without needing to undergo maintenance and recharging. In this case, the portion of the thin layer supporting fabric 2 which is superimposed to the inflated bag 13, thanks to the elasticity of the supporting fabric 2, can apply a compression force over it assisting the expulsion of the gas from the inflatable bag 13.

Figure 3A:
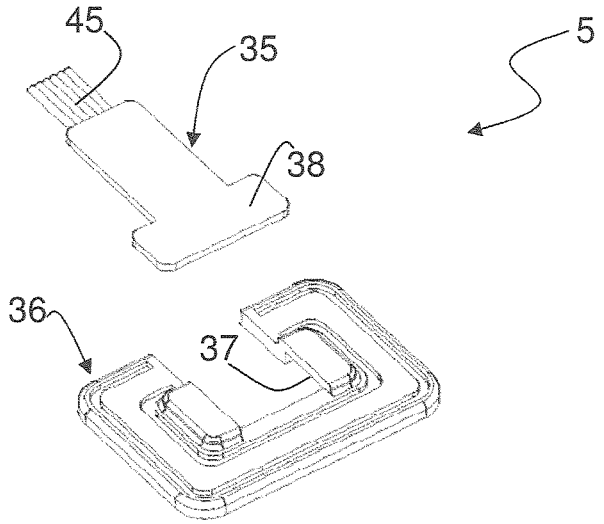
FIG. 3A shows a schematic exploded view of a component of the standalone wearable protector according to the invention.
Figure 3B:
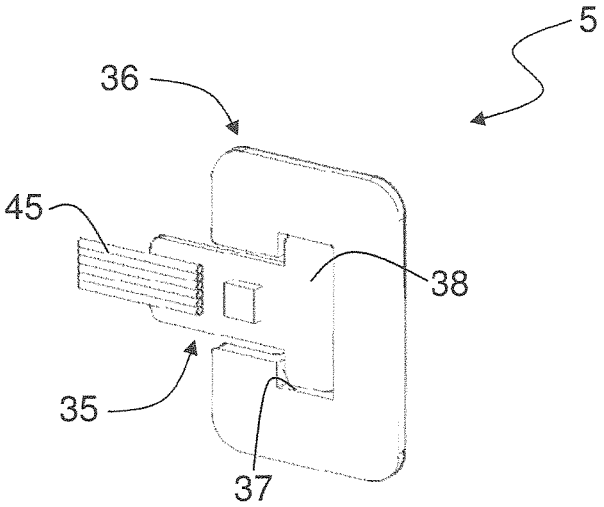
FIG. 3B shows an assembled view of the component of the standalone wearable protector of FIG. 3A.

As it has been anticipated, the standalone wearable protector 1 comprises sensing means 5, connected to the control unit 12, and arranged on the thin layer supporting fabric 2. The sensing means 5 preferably comprise a printed circuit board 35, or PCB, intended to support their elements. According to the embodiments of FIGS. 3A and 3B, the PCB 35 has a "T" shape. The PCB 35 is arranged on the thin layer supporting fabric 2 using a flexible support 36. Said flexible support 36 is preferably made of rubber. Moreover the flexible support 36 can be permanently or removably fixed to the thin layer supporting fabric 2.

The flexible support 36 comprises a cavity 37 suitable for housing at least partially the PCB, for example for housing at least partially the head end 38 of the T-shaped PCB 35.

According to an advantageous manner for inserting the PCB 35 inside the flexible support 36, the latter is flexed so as to permit the PCB 35 to be inserted at least partially inside the cavity 37 of the support 36. When the support 36 is released, the sensor 5 is held in position. In particular, for allowing the insertion of the T-shaped PCB 35 inside the flexible support 36, the latter is flexed so as to permit the head end 38 of the T-shaped PCB 35 to be inserted inside the cavity 37 of the support 36. When the support 36 is released, the sensor 5 is held in position.

In this wav, it is easy to replace the sensors 5 in case they need to be substituted, without compromising the integrity of the thin layer supporting fabric 2.

Alternatively, said sensing means 5 can be integrated in the thin layer supporting fabric 2.

Being integrated in the thin layer supporting fabric 2 means that the sensing means 5 are positioned in a seat or pocket provided on the inner or outer surface of the thin layer supporting fabric 2.

In this embodiment the sensing means 5, besides being positioned in a seat or pocket, can be also fixed to the thin layer supporting fabric 2 using the flexible support previously disclosed.

Preferably the opening of the pocket s closed by a seal. In this case, the pocket is closed in a way that it is not possible for the user to access the inside of the pocket without breaking the seal.

Said sensing means 5 preferably are accelerometers and are independent from any other sensor external to the standalone wearable protector (for example, installed on the motorcycle). Said sensing means 5 can be positioned in different areas of the thin layer supporting fabric 2 (in the embodiments of the attached figures, for sake of clarity, only the sensors positioned on the shoulder portion of the thin layer supporting fabric 2 are shown). Such sensing means 5 are connected by means of wired 45 and/or wireless connections to the control unit 10 of the standalone wearable protector 1.

The inputs received by the various sensors 5 positioned on the thin layer supporting fabric 2 are continually monitored by the control unit 10 and, if a crash situation is detected (according to a preloaded logic), a fire signal is transmitted to the gas generator 12 for permitting a rapid inflation, in approximately 50-100 ms, of the inflatable bag 13.

From the above description, it can be appreciated that the standalone wearable protector 1 is suitable for being used on its own or on top of a garment worn by the user.

In case the standalone wearable protector 1 is used on its own, being the thin layer supporting fabric 2 unable to resist abrasion and friction stresses, additional protective elements 24, 25 could be added on the outer surface of the thin layer supporting fabric 2. The function of said additional protective elements 24, 25 is to improve the impact protection offered by the standalone wearable protector 1 and for protecting the inflatable bag 13 against abrasion and tearing.

As it is shown in FIG. 6, said additional protective elements 24, 25 may comprise shoulder protections 24 and/or chest protections 25 and they can be used in conjunction with the back shield 3.

As mentioned above, the standalone wearable protector 1 may also be worn on top of a normal garment or on top of a protective garment.

As a normal garment it must be intended a garment simply designed for covering a portion of the user's body, while as a protective garment must be intended a garment designed for covering and at the same protecting in some manner at least a portion of the user's body.

In both cases it is not needed that the garment worn underneath the standalone wearable protector 1 is specifically designed to be used in conjunction with the standalone wearable protector 1.

As a matter of fact, thanks to its elastic properties, the thin layer supporting fabric 2 is able to adapt itself to the garment worn underneath by the user.

This permits the rider to benefit from the high level of protection provided by the standalone wearable protector 1 even if he/she does not own a garment specifically designed for being used in conjunction with the standalone wearable protector 1.

Also in this occurrence, additional material layers and possible addition of further plastic shields, in addition to those of the back shield 3, could be added to the thin layer supporting fabric 2 to improve the impact protection and resistance to abrasion of the standalone wearable protector 1 (see FIG. 6).

According to the above description, it should be noted that the standalone wearable protector 1 would not be suitable for being worn underneath generic garment. As a matter of fact, the garment worn on top of the thin layer supporting fabric 2 unavoidably would prevent a correct inflation of the inflatable bag. Such inflation, in case of a danger situation, would take place towards the body of the user instead than outwardly.

Therefore, for allowing the use of the standalone wearable protector 1 also underneath abrasion resistant garment, a novel and innovative protective clothing assembly has been conceived.

Such protective clothing assembly comprises a compatible protective garment 30, 50 made of material resistant to abrasion and friction stresses and the standalone wearable protector 1 above disclosed.

As compatible protective garment must be intended a protective garment provided with yielding areas 31, 32, 51 suitable for being at least partially superimposed over the at least one inflatable bag 13 of the standalone wearable protector 1, when the latter is worn underneath the compatible garment.

In this occurrence, the yielding areas 31, 32, 51 allow the inflatable bag 13 to expand once, following to the detection of a crash situation, it is inflated by the gas generator 12 of the standalone wearable protector 1.

Moreover, said yielding areas 31, 32, 51 are also able to reduce the pressure subjected to the rider when the inflatable bag 13 is inflated.

A first embodiment of the protective clothing assembly according to the invention comprises an abrasion resistant suit 30 and a standalone wearable protector 1.

Figure 4:
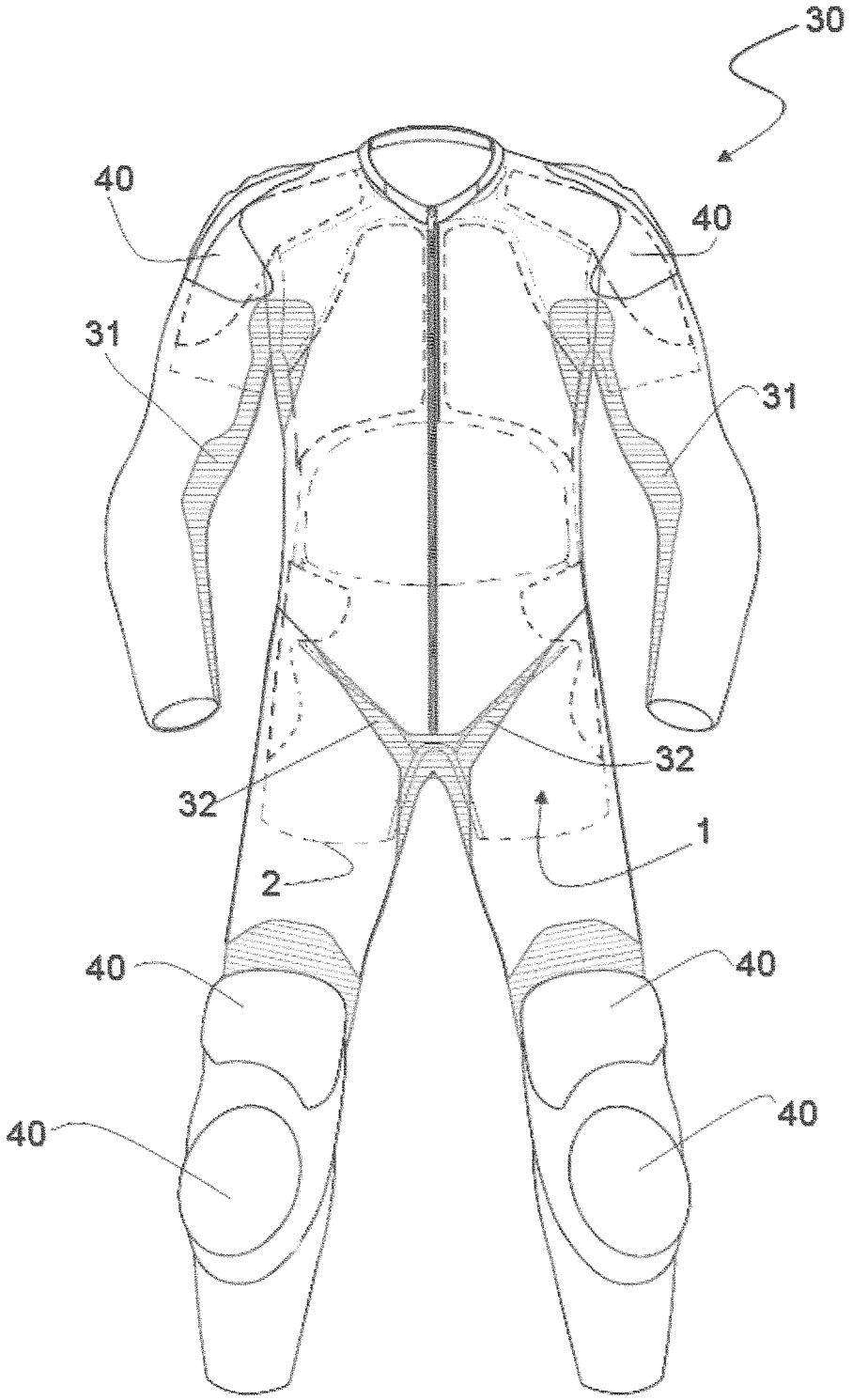
FIG. 4 shows a front view of another embodiment of the protective clothing assembly according to the invention, in a first operating condition.

In FIG. 4, there is schematically shown the hatched outline of the exemplifying embodiment of the standalone wearable protector 1 of FIG. 1, when it is worn underneath a compatible abrasion resistant suit 30. Said compatible suit 30 is designed to cover the whole of the user's body, except for the head, the hands and the feet. As it is well known in the art, the suit 30 can be provided with protective elements 40 in the region of the shoulders, the elbows, the knees and the back.

According to the exemplifying embodiment of FIG. 4, the compatible suit 30 is provided with yielding areas 31, 32 in the region of the armpits, the arms and the groin. Said yielding areas 31, 32 are preferably made of stretchable material.

The stretch areas 31 positioned along the arms and armpits portion of the suit 30, allows the portion of the underneath inflatable bag 13, designed for protecting the shoulders, the chest and the back of the user's body, to expand without being hindered by the leather or the abrasion-resistant material of the suit 30.

Figure 5:
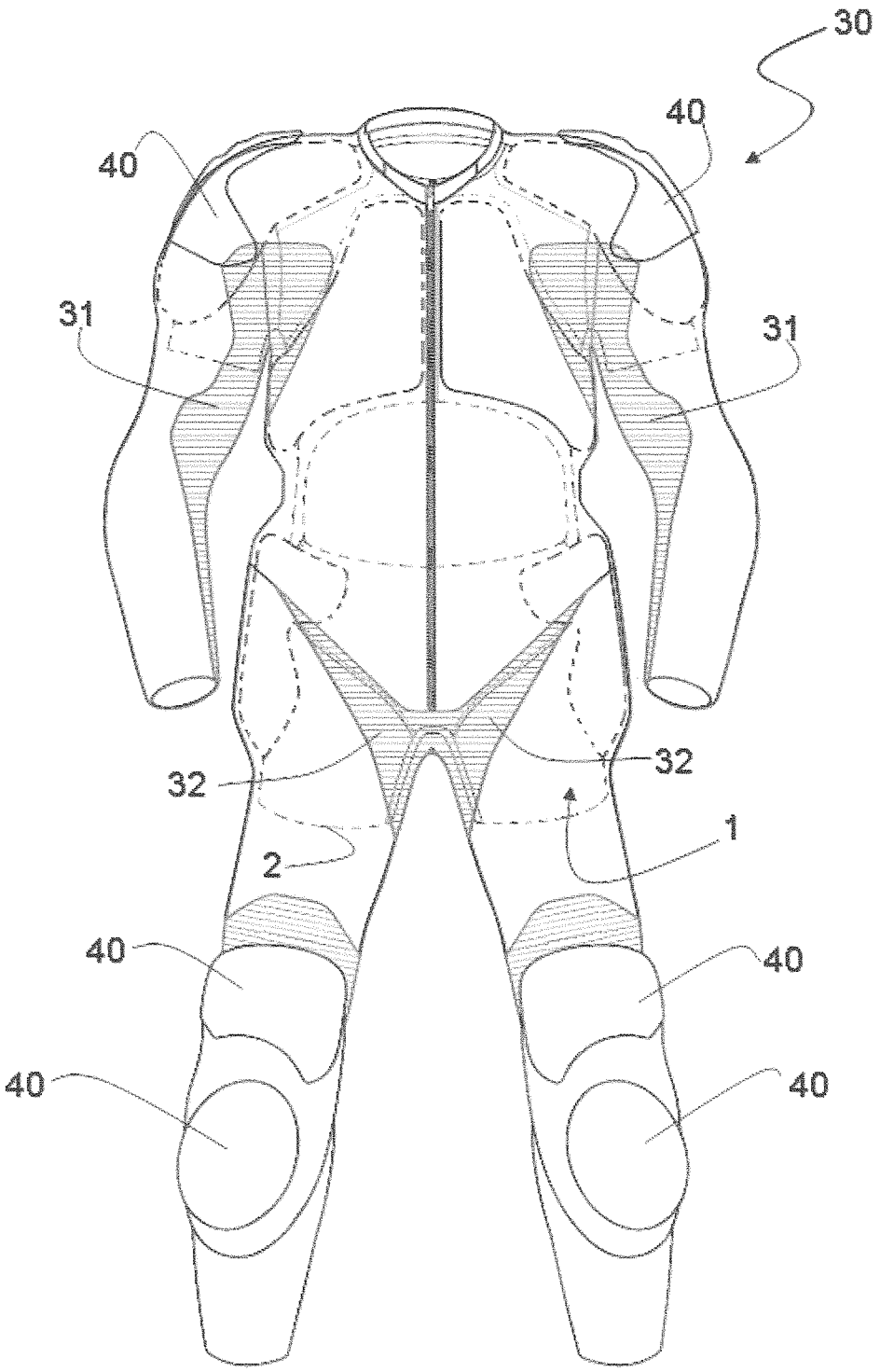
FIG. 5 shows a front view of the protective clothing assembly of FIG. 4, in a second operating condition.

Similarly, the stretch areas 32 positioned along the groin portion of the suit 30 allows the portion of the underneath inflatable bag 13, designed for protecting the hip of the user's body to expand without being hindered by the leather or the abrasion-resistant material of the suit 30 (see FIG. 5).

Moreover, due to provision of the stretch areas 31, 32, the time of inflation of the inflatable bag 13, notwithstanding the presence of the suit 30 on top of the thin layer supporting fabric 2 of the standalone wearable protector 1, is delayed only to a small degree. Therefore, the level of safety offered by the standalone wearable protector 1 when it is worn underneath a compatible suit 30 is comparable to that offered when it is worn on its own.

Furthermore, the provision of the stretch areas 31, 32, 51 does not reduce the abrasion resistance offered by the suit 30 since they are positioned in areas that, in case of falling of the riders, rarely come in direct contact with the ground.

A second embodiment of the protective clothing assembly according to the invention comprises an abrasion resistant jacket 50 and a standalone wearable protector 1.

In FIG. 7, there is schematically shown the hatched outline of the exemplifying embodiment of the standalone wearable protector 1 of FIG. 6 when it is worn underneath a compatible protective jacket 50 made of leather or other abrasion-resistant material.

As it is well known in the art, the protective jacket 50 can be provided with protective elements 55 in the region of the shoulders, the elbows and the back.

According to the exemplifying embodiment of FIG. 7, the compatible protective jacket 50 is provided with yielding areas 51 in the region of the armpits and the arms. Said yielding areas 51 preferably are made of stretchable material.

The stretch areas 51 positioned along the arms and armpits portion of the jacket 50 allow the portion of the underneath inflatable bag 13, designed for protecting the shoulder portion, the chest portion and the back portion of the user's body, to expand without being hindered by the leather or the abrasion-resistant material of the jacket 50.

As it has been previously noted with reference to the compatible suit 30, thanks to the provision of the yielding areas 51, notwithstanding the presence of the jacket 50 on top of the thin layer supporting fabric 2 of the standalone wearable protector 1, the time of inflation of the inflatable bag 13 is delayed only to a small degree. Therefore, the level of safety offered by the standalone wearable protector 1 when it is worn underneath a compatible jacket 50 is comparable to that offered when it is worn on its own.

Different arrangements of the yielding areas 31, 32, 51 are possible, in order to meet other specific needs. Moreover other arrangements can be used for the protective garment 30, 50 in order to allow expansion of the inflatable bag 13. For example flaps can be provided in the outer abrasion resistant garment which can open outwardly (see EP 1615514 in the name of the same applicant for a similar solution).

Said flaps can be releasably joined to the abrasion protective suit 30 or jacket 50 by means of Velcro® strips or stitches with a predefined breakage strength arranged along the edges of said flaps.

The innovative concept of the standalone wearable protector 1 is not limited purely to the embodiments listed above. The single inflatable bag or the plurality of inflatable bags of the standalone wearable protector 1 may be enlarged or reduced to work with different abrasion resistant garments and to cover different areas of the user's body, such as jackets (upper body protection) or pants (lower body protection).

The positioning of the gas generator 12 and control unit 10 may also be located anywhere in the coverage of the thin layer supporting fabric 2.

From the above description, it is clear that by using the standalone wearable protector 1 of the present invention the user is no longer forced to own duplicate sets of inflatable devices. As a matter of fact, he/she can use the same standalone wearable protector 1 in conjunction with different abrasion resistant garments. Moreover, when the standalone wearable protector needs to be recharged, since it is independent from any other protective component or garment, it can be sent alone to a repair centre. In this way a remarkable reduction in ownership and maintenance costs is reached.

For example, if the rider wears the standalone wearable protector underneath an abrasion resistant garment and he/she is involved in a small crash which does not cause the activation of the standalone wearable protector, but causes damages to the outer abrasion resistant garment, the same standalone wearable protector can be simply worn with another abrasion protective garment.

As a matter of fact, the rider does not need to have another complete leather suit (with inflatable protective device) on standby. By using the standalone wearable protector 1 of the present invention, the rider can simply remove from his body the damaged leather suit (not provided with an inflatable protective device) and, by keeping in position his/her standalone wearable protector, he/she can wear a new suit.

In this way, the rider is not forced, for obtaining the same level of safety offered by the garment provided with inflatable protective device, to buy a new abrasion resistant garment provided with a new inflatable device.

Moreover, it should be noted that due to the technical features of the standalone wearable protector the rider has the opportunity to interchangeably use the standalone wearable protector with different garments.

The present invention has been described with reference to a preferred embodiment, but mechanically equivalent solutions are foreseeable falling within the scope of the following claims.

The invention claimed is:

1. Protective clothing assembly configured for motorcycle drivers, comprising:

at least one protective garment made of a material resistant to abrasion and friction stresses; and a standalone wearable protector comprising a thin layer supporting fabric for covering at least a trunk portion of a user's body when worn and being substantially non-resistant to abrasion and to friction stresses, said thin layer supporting fabric serving as a support for each collectively of at least one inflatable bag, at least one gas generator, a control unit, and sensors, said at least one inflatable bag being housed in a seat provided in the thin layer supporting fabric, said at least one gas generator connected to said at least one inflatable bag, said at least one gas generator being fastened directly or indirectly to said thin layer supporting fabric, said control unit fastened directly or indirectly to said thin layer supporting fabric, and said sensors connected to said control unit and provided on said thin layer supporting fabric, the control unit configured for activating the at least one gas generator in event of a danger situation being detected by the sensors, said standalone wearable protector being worn underneath said at least one protective garment;

wherein said at least one protective garment is provided with at least one yielding area which is at least partially superimposed over at least one inflatable bag of the standalone wearable protector, said at least one yielding area allowing said at least one inflatable bag to expand after being inflated by the gas generator of the standalone wearable protector.

2. The protective clothing assembly according to claim 1, wherein the at least one protective garment comprises a suit.

3. The protective clothing assembly according to claim 1, wherein said at least one yielding area is adapted for being provided in a region of one or more of armpits, arms, and groin of a user with said at least one protective garment.

4. The protective clothing assembly according to claim 1, wherein said at least one yielding area is made of stretchable material.

5. The protective clothing assembly according to claim 1, wherein said at least one yielding area is a flap releasably joined to said at least one protective garment.

6. The protective clothing assembly according to claim 1, wherein the at least one protective garment comprises a jacket.

7. Protective clothing assembly configured for motorcycle drivers, comprising:

at least one garment suitable for covering a portion of the user's body;

a standalone wearable protector comprising a thin layer supporting fabric for covering at least a trunk portion of a user's body when worn and being substantially non-resistant to abrasion and to friction stresses, said thin layer supporting fabric serving as a support for each collectively of at least one inflatable bag, at least one gas generator, a control unit, and sensors, said at least one inflatable bag being housed in a seat provided in the thin layer supporting fabric, said at least one gas generator connected to said at least one inflatable bag, said at least one gas generator being fastened directly or indirectly to said thin layer supporting fabric, said control unit fastened directly or indirectly to said thin layer supporting fabric, and said sensors connected to said control unit and provided on said thin layer supporting fabric, the control unit configured for activating the at least one gas generator in event of a danger situation being detected by the sensors, said standalone wearable protector being worn on top of said at least one garment;

wherein additional protective elements are provided on the outer surface of the thin layer supporting fabric, the function of said additional protective elements being to improve the impact protection offered by the standalone wearable protector and for protecting the at least one inflatable bag against abrasion and tearing.

8. The protective clothing assembly according to claim 7, wherein said additional protective elements comprise protections adapted for shoulders of a user.

9. The protective clothing assembly according to claim 7, wherein said additional protective elements comprise protections_adapted for a chest of a user.

* * * * *